US005240082A

United States Patent [19]

Hayabuchi et al.

[11] Patent Number: 5,240,082

[45] Date of Patent: Aug. 31, 1993

[54] ROTARY BORING MACHINE

[75] Inventors: Keitaro Hayabuchi, Tokorozawa; Mitsuo Hatayama, Tokyo, both of Japan

[73] Assignees: Obayashi Corporation, Osaka; Jal Data Communications & Systems Co., Ltd., Tokyo; Seiko Kogyo Co., Ltd., Osaka, all of Japan

[21] Appl. No.: 923,587

[22] Filed: Aug. 3, 1992

[30] Foreign Application Priority Data

Aug. 2, 1991 [JP] Japan ..... 3-216464

[51] Int. Cl.[5] ..... E21B 19/00

[52] U.S. Cl. ..... 175/24; 175/26; 175/40

[58] Field of Search ..... 175/24, 26, 40

[56] References Cited

U.S. PATENT DOCUMENTS 3,872,932 3/1975 Gosselin ..... 175/26 X
4,637,479 1/1987 Leising ..... 175/26
4,825,962 5/1989 Girault ..... 175/26
5,130,706 7/1992 Van Steenwyk ..... 175/40 X

*Primary Examiner*—Thuy M. Bui
*Attorney, Agent, or Firm*—Wenderoth, Lind & Ponack

[57] ABSTRACT

A rotary boring machine includes a base machine placed on the ground, a boring drill provided with the base machine and driven for rotation, a dip gauge provided at a tip end of the boring drill, a first circuit provided in an intermediate portion of the boring drill and electrically connected to the dip gauge for producing a varying flux corresponding to an output signal of the dip gauge, and a second circuit provided in the intermediate portion of the boring drill in opposition to the first circuit and inducting an induction current corresponding to the output signal of the dip gauge through an electromagnetic induction caused by the varying flux generated by the first circuit. The output signal of the dip gauge is transmitted by electromagnetic induction between the first and second circuits and thus is transmitted to the base machine without requiring physical connection of signal transmission lines.

10 Claims, 6 Drawing Sheets

ROTARY BORING MACHINE

BACKGROUND OF THE INVENTION

1. Field of the Invention

The present invention relates generally to a rotary boring machine. More specifically, the invention relates to a rotary boring machine which does not require attaching and detaching an output signal transmission line for a dip gauge at every operation of connecting and disconnecting connecting rod.

2. Description of the Related Art

In general, a dip gauge and depth gauge are provided for a rotary boring machine for continuously monitoring verticality of a boring drill and a boring depth. Among these, since the depth can be measured by an amount of extraction of a wire supporting the boring drill, the depth gauge can be installed at the side of a base machine. However, the dip gauge has to be installed at the tip end of the boring drill. The dip gauge must be connected to the base machine via a signal transmission line extending through a hollow interior space of the boring drill and via a slip ring. In case, the depth of boring is deep, a plurality of connecting rods must be connected above the boring drill from time-to-time as the boring depth increases. Upon connection of the connecting rods, it becomes necessary to connect the signal transmission line for permitting the dip gauge to provide information. For this purpose, a connection structure of the signal transmission lines for the output signals of the dip gauges as illustrated in FIGS. 7(*a*) and 7(*b*) are typically employed.

As shown in FIGS. 7 (*a*) and 7(*b*), a convex joint portion 1*b* is formed at the upper end of a hollow connection rod 1. Also, a concave joint portion 1*a* is formed at the lower end of the connection rod 1. A clearance d for injecting mortar is defined along the longitudinal axis of the connecting rod 1. A sheathing pipe 2 is fixedly arranged substantially along the longitudinal axis of the connecting rod 1. A concave joint 2*b* is provided at the upper end of the sheathing pipe 2. A conforming convex joint 2*a* is formed at the lower end of the sheathing pipe 2. A curled expansible code or cable 3 forming the signal transmission line for the dip gauge is arranged through the interior space of the sheathing pipe 2. At upper and lower ends of the curled code 3, male and female connectors 4*a* and 4*b* are provided for electrical connection.

In such conventional connection structure for the signal transmission line of the dip gauge, when the connection rods are mutually connected, a worker should extract the curled code 3 from the sheathing pipe 2, and then the male and female connectors 4*a* and 4*b* are coupled or connected to each other. Thereafter, the connecting rods 1 are connected through the joint portions 1*a* and 1*b*. Then, the sheathing pipes 2 of respective connecting rods 1 can be mutually connected at the joints 1*a* and 2*b* to complete connection of the connecting rods 1 with connection of the curled codes 3. Thus, the connection rods 1 are engaged in integral fashion with the engagement between the convex joint 2*a* and the concave joint 2*b*.

However, in such construction as set forth above, connection and disconnection of the connectors 4*a* and 4*b* of the curled codes 3 has to be done in a position where the connection rods 1 are positioned in close proximity to one another. Placement of the connection rods 1 in close proximity and connection and disconnection of the connectors 4*a* and 4*b* for connecting and disconnecting the curled codes 3 are substantially time-consuming and complicated operations. It is also difficult to assure security for such operation. Also, due to possibility of breakage of the curled code 3 during operation, penetration of a cementing solution into the joint of the sheathing pipes 2, or wearing of shields of the curled codes 3, the curled codes 3 and the connectors 4*a* and 4*b* have to be replaced frequently. This clearly results in high maintenance cost.

SUMMARY OF THE INVENTION

The present invention is provided to solve the above-mentioned problems in the prior art. Therefore, it is an object of the present invention to provide a rotary boring machine which can establish connection of an output signal transmission line for a dip gauge simply by connecting connection rods and permits transmission of an output signal of the dip gauge to a base machine via the connected connection rods.

In order to accomplish the above-mentioned object, a rotary boring machine according to the present invention, comprises:

a base machine placed on the ground;

a boring drill provided with the base machine and driven for rotation;

a dip gauge provided at a tip end of the boring drill;

a first circuit provided in an intermediate portion of the boring drill and electrically connected to a dip gauge for producing a varying flux corresponding to the output signal of the dip gauge;

a second circuit provided in the intermediate portion of the boring drill in opposition to the first circuit and inducting an induction current corresponding to the output signal of the dip gauge through an electromagnetic induction caused by the varying flux generated by the first circuit.

Preferably, each of the first and second circuits has at least an inductance element. In a further preferred construction, and air-core coil is typically employed as the inductance element.

Further preferably, the boring drill comprises a drilling tip end and a connection rod of hollow rod shaped configurations.

Also, it is preferred that the drilling tip end is provided with a first circuit at the end of the drilling tip end to be connected with the connection rod. Also, the connection rod is provided at one end thereof with a first circuit and at the other end thereof with a second circuit with electrical connection of the first and second circuits at the respective ends through an electrical signal transmission means such as a coaxial cable.

In the further preferred construction, a concave connecting portion is formed at the upper end of the drilling tip end for connection with the connection rod. Also, a convex connecting portion in conformance with the concave connecting portion formed at the upper end of the drilling tip end, is formed at the lower end of the connection rod, and a concave connecting portion in conformance with the convex connecting portion at the lower end is formed at the upper end of the connection rod.

With the construction set forth above, the output signal of the dip gauge, provided at the tip end of the boring drill of the rotary boring machine according to the present invention, is transmitted between the first circuit provided in an intermediate portion of the boring drill and electrically connected to the dip gauge for producing a varying flux corresponding to the output signal of the dip gauge, and the second circuit provided in the intermediate portion of the boring drill in opposition to the first circuit and inducting an induction current corresponding to the output signal of the dip gauge through an electromagnetic induction caused by the varying flux generated by the first circuit, and thus is transmitted to the base machine without requiring physical connection of signal transmission lines at the intermediate portion.

Though the specification is completed by particularly pointing out and definitely claiming the principle of the invention in the appended claims, the present invention will be clearly understood from the following discussion given with reference to the accompanying drawings.

DESCRIPTION OF THE PREFERRED EMBODIMENT

Figure 1:
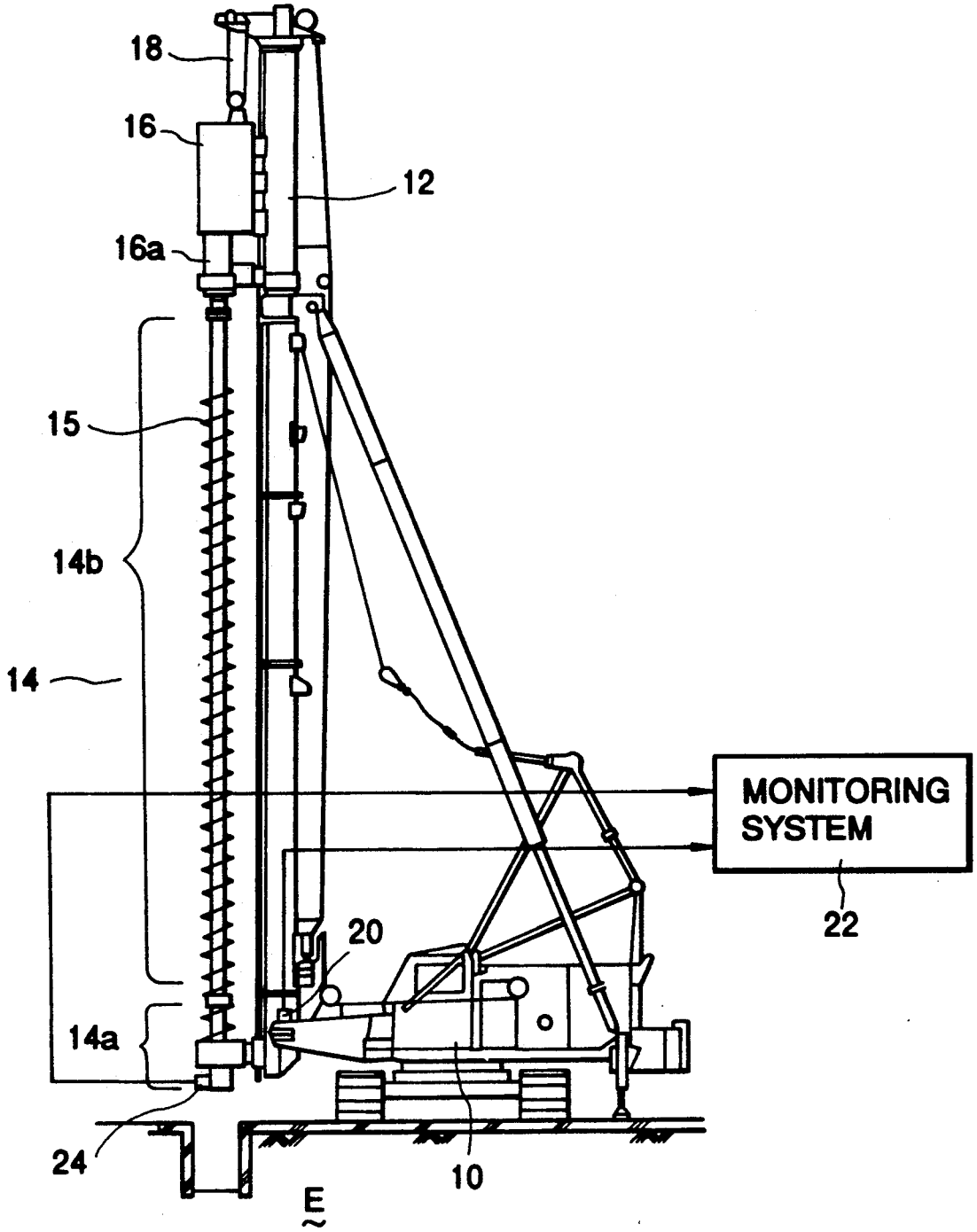
FIG. 1 is an explanatory illustration showing overall construction of a rotary boring machine according to the present invention.

The preferred embodiments of a rotary boring machine according to the present invention will be discussed herebelow in detail with reference to the accompanying drawings. FIG. 1 shows an overall construction of a rotary boring machine associated with the present invention. The shown rotary boring machine is an auger boring machine which includes a base machine 10 to be placed on the ground and an auger 14 as a boring drill. The auger 14 is guided for vertical movement along a guide bar 12. A rotary driving mechanism 16 is provided above the auger 14 for rotatingly driving the auger 14. The rotary driving mechanism 16 is designed to move up and down along the guide bar 12 according to extraction and retraction of a wire 18 for penetrating the auger 14 into the ground E.

The auger 14 is formed into a hollow rod shaped configuration and provided with a screw form bit 15. The auger 14 has a drilling tip end 14*a* at the lower end portion and a connecting rod 14*b*. The upper end of the connecting rod 14*b* is detachably connected to an output shaft 16*a* of the rotary driving mechanism 16.

According to progress of boring, one or more intermediate connection rods (not shown) are connected between the output shaft 16*a* and the connection rod 14*b* to enable boring to proceed a predetermined depth by increasing the number of the intermediate connection rods. Conversely, upon withdrawing of the auger, the intermediate connection rods are removed in order until the drilling tip end 14*a* is withdrawn.

A depth detector or depth gauge 20 is provided at the lower portion of the guide bar 12 for detecting boring depth of the auger 14 based on the amount of extraction amount of the wire 18. The output of the depth detector 20 is input to a monitoring system 22 provided in the base machine 10. The monitoring system 22 records the variation of the boring depth in time. Also, the monitoring system 22 may perform data processing, such as upper limit judgement of the boring depth or so forth. On the other hand, a dip gauge 24 is arranged in the drilling tip end 14*a* of the auger 14. The output signal of the dip gauge 24 is input to the monitoring system 22 through the interior space of the auger 14. The monitoring system 22 thus records the output signal from the dip gauge 24 and may perform data processing, such as upper limit judgement for the boring depth or so forth.

Figure 2:
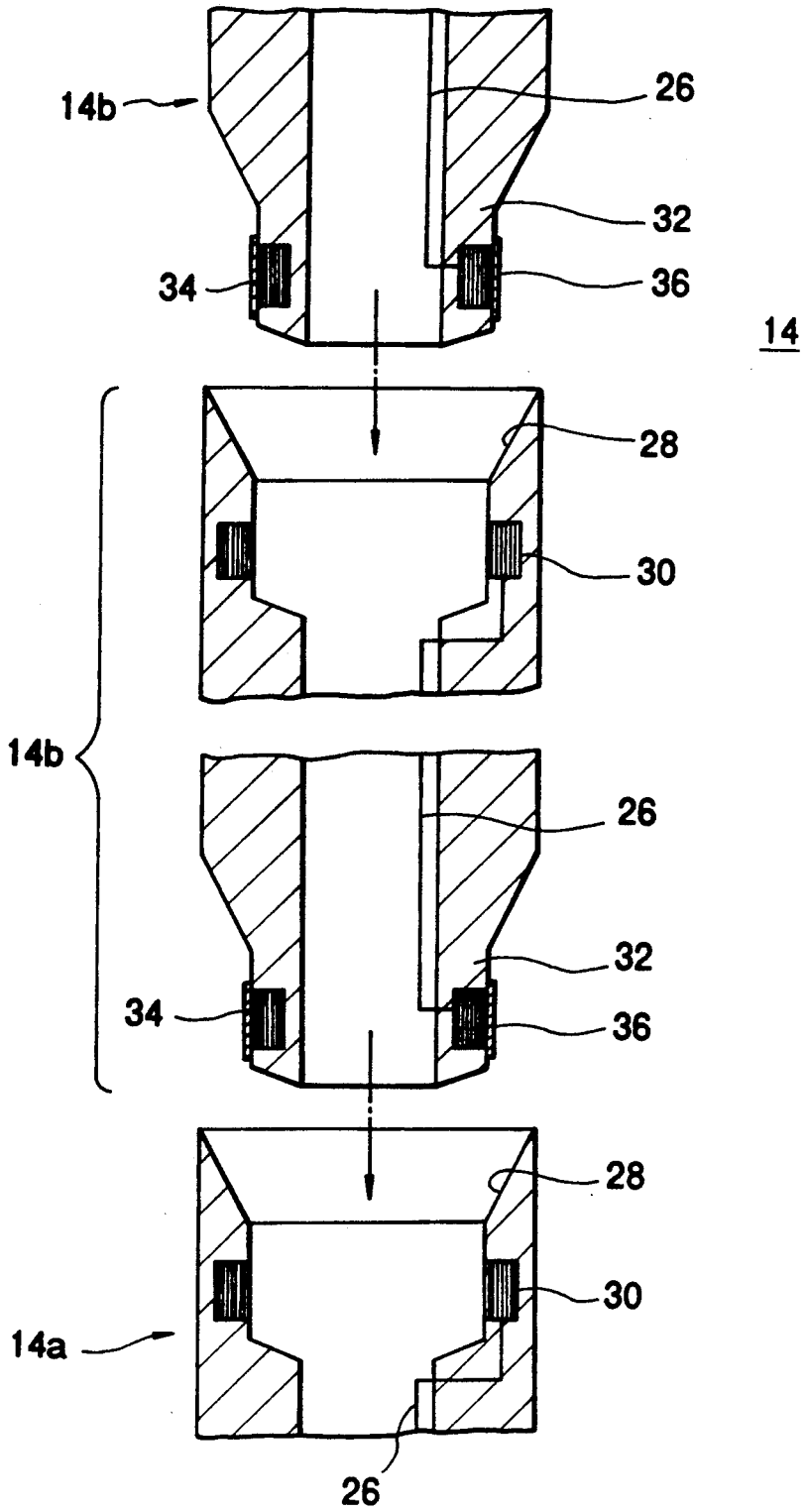
FIG. 2 is an enlarged exploded partial section of one embodiment of the rotary boring machine according to the present invention.

The dip gauge 24 is designed to output an electric signal depending upon the dip angle at the drilling tip end 14*a*. As shown in FIG. 2, an output terminal of the dip gauge 24 is connected to a first circuit 30 provided on a concave joint portion 28 formed at the upper end of the drilling tip end 14*a* via a signal transmission line 26, such as a coaxial cable which extends through the hollow interior of the drilling tip end 14*a*.

A convex joint portion 32 is formed at the lower end of the connection rod 14*b* so as to integrally connect the connection rod with the drilling tip end by engaging the concave joint portion 28 of the drilling tip end. A second circuit 34 is provided on the outer periphery of the convex joint portion 32. The second circuit 34 is covered with an insulating cover 27 made of a plastic or so forth. The insulating cover 36 is adapted to protect the second circuit 34 from mud, muddy water, dust or so forth.

Figure 3:
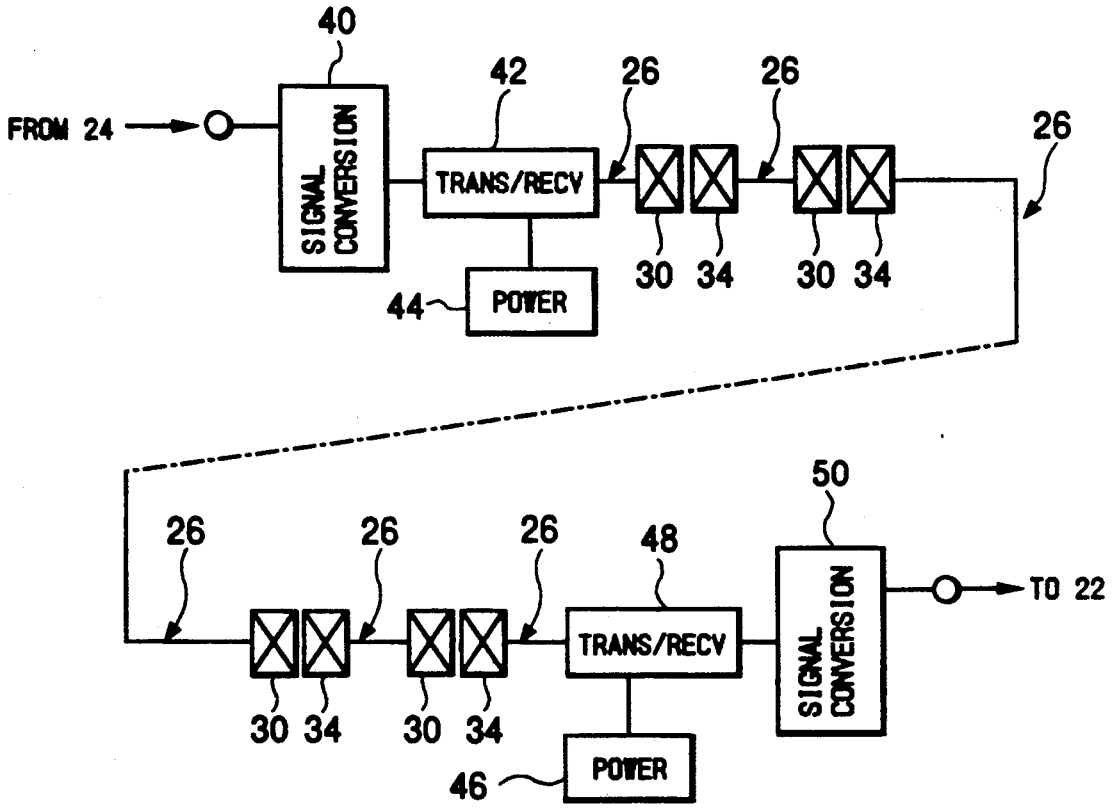
FIG. 3 is a block diagram of one embodiment of a signal transmission system according to the invention.
Figure 4:
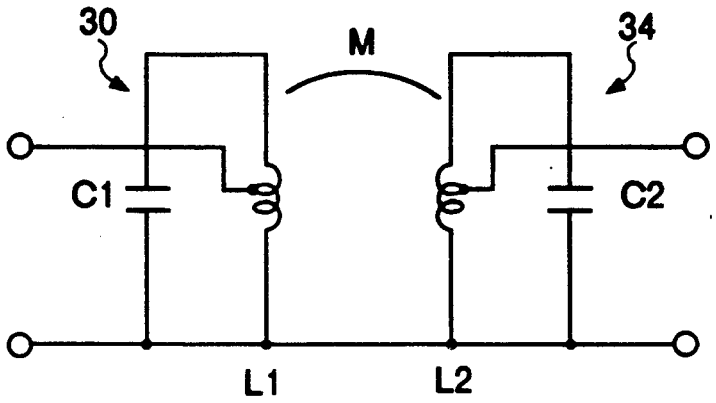
FIG. 4 is a schematic circuit diagram showing coupling condition of first and second circuits.

FIG. 3 shows a block diagram of a signal transmission system to be employed in one embodiment of the rotary boring machine according to the present invention. As shown, a signal transmission line 26 is provided between signal transmitting and receiving portions 42 and 48. At an intermediate portion of the signal transmission line 26, one or more pairs of the first and second circuits 30 and 34 are provided. In the illustrated embodiment, four pairs of first and second circuits 30 and 34 are provided. This construction corresponds to the case where two intermediate connection rods are interposed between the drilling tip end 14*a* and the output shaft 16*a* of the rotary driving mechanism 16. The pairs of first and second circuits 30 and 34 are designed to transfer electric signals through mutual inductance coupling (so-called M coupling) of resonating circuits across the insulating cover 36, as shown in FIG. 4. The first circuit 30 is formed as a resonating circuit with a coil $L_1$ and a capacitor $C_1$. Similarly, the second circuit 34 is formed as a resonating circuit with a coil $L_2$ and a capacitor $C_2$.

Figure 5A:
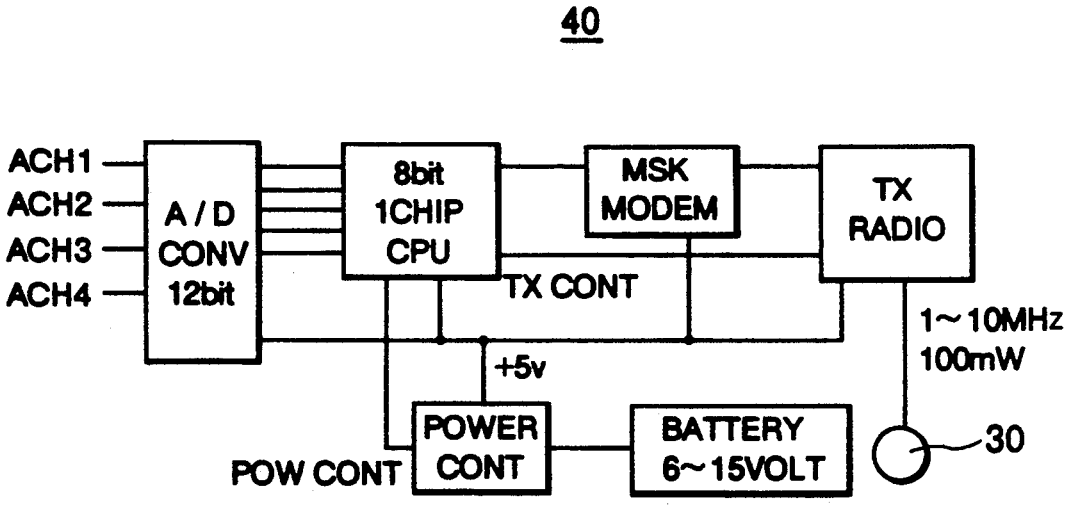
FIGS. 5(*a*) and 5(*b*) are schematic block diagrams of a signal converting portion shown in FIG. 3, in which FIG. 5(*a*) is a schematic block diagram of a transmitting portion and FIG. 5(*b*) is a schematic block diagram of a receiving portion.
Figure 5B:
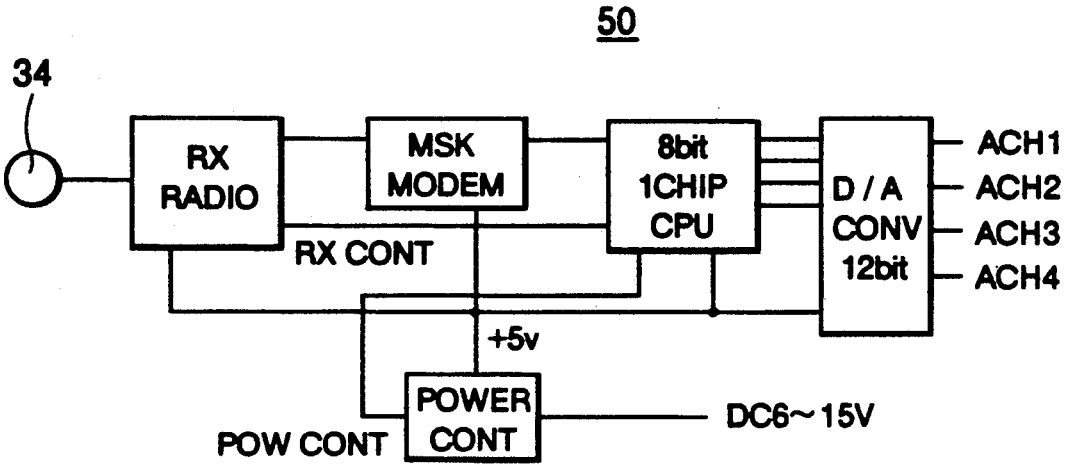

Each of the signal transmitting and receiving portions 42 and 48 is connected to a respective signal converting portion 40 and 50 and a respective power source 44 and 46. Upon transmission, the signal converting portion 40 forms the circuit configuration as illustrated in FIG. 5(*a*) so as to convert up to four types of analog signals $ACH_1 \sim ACH_4$ into digital signals. The digital signals thus converted are frequency modulated with a predetermined carrier wave and fed to the signal transmission line 26. On the other hand, upon receiving the signal, the signal converting portion 50 forms the circuit configuration as illustrated in FIG. 5(*b*), in which the digital signals are converted into analog signals to provide information.

Here, manner of signal transmission between the first and second circuits 30 and 34 will be discussed. When the concave joint portion 28 and the convex joint portion 32 are engaged for connection, the first circuit 30 surrounds the second circuit 34 via the insulating cover 36. At this portion, the coils $L_1$ and $L_2$ form a type of transformer. Therefore, when the output signal of the dip gauge 24 is to be transferred from the first circuit 30 to the second circuit 34, the waveform of the induction current corresponding to the waveform of the output signal is generated in the second circuit 34 through electromagnetic induction. Namely, depending upon the output signal current of the dip gauge 24 flowing through the coil $L_1$ of the first circuit 30, the coil $L_1$ generates a varying flux corresponding to variation of the current of the output signal current. When this varying flux passes across the cover 36 to the second circuit 34 provided in opposition to the first circuit 30, an induction current corresponding to the varying flux flows in the coil $L_2$ of the second circuit 34. Namely, the output signal of the dip gauge 24 is transmitted through the connecting portion between the concave joint portion 28 and the convex joint portion 32 in non-contacting position without employing a connecting means, such as a connector.

The second circuit 34 is connected to the lower end of the signal transmission line 26 provided through the hollow interior of the connection rod 14*b*. The upper end of this signal transmission line 26 is connected to the first circuit 30 provided on the inner periphery of the concave joint portion 28 of similar configuration at the upper end of rod 14*b*. Namely, the output signal of the dip gauge 24 is transmitted to the base machine 10 through the coupling between the first and second circuits 30 and 34 from the drilling tip end 14*a* through the connection rod 14*b* and the intermediate connection rods.

Figure 6:
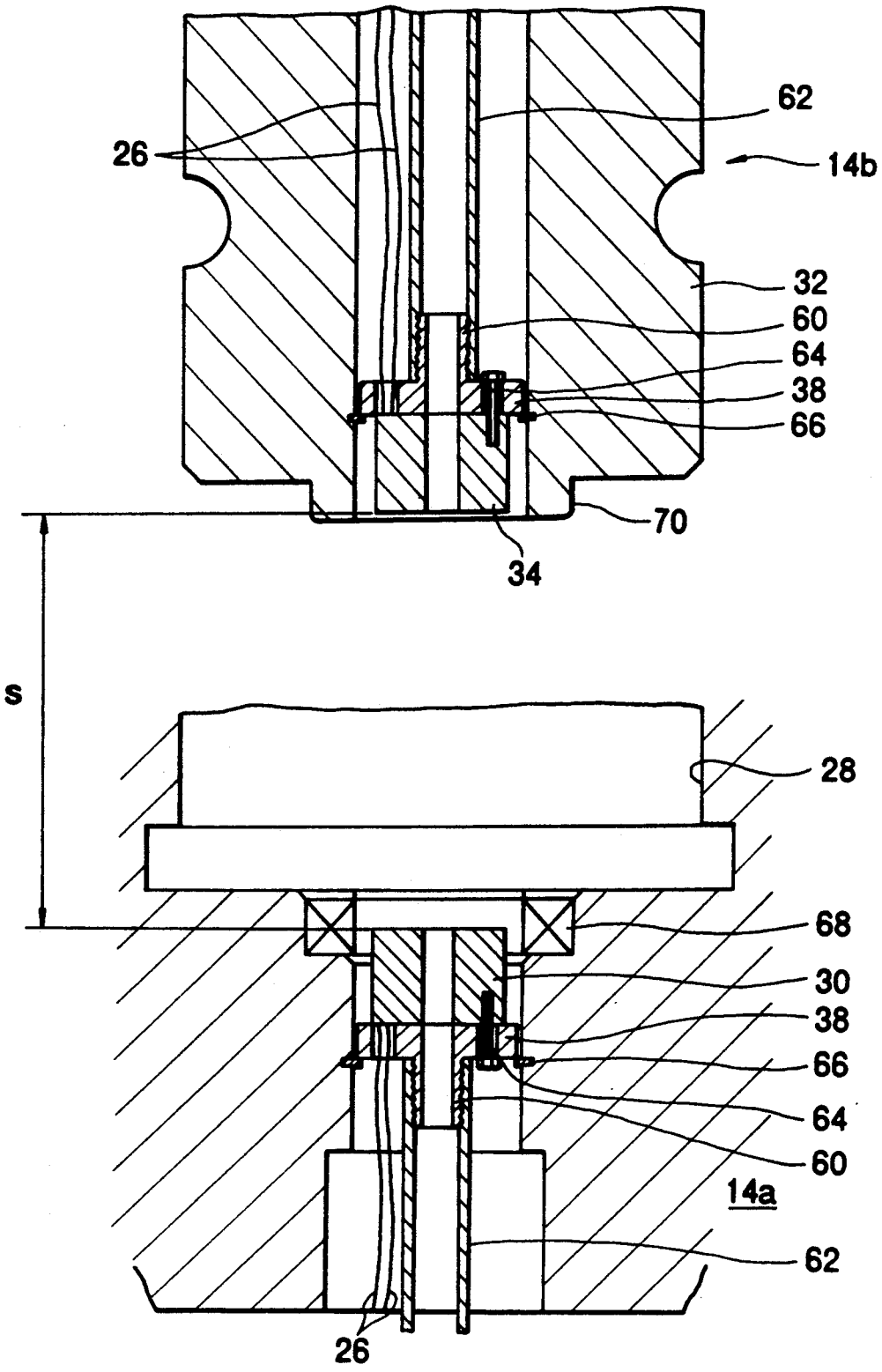
FIG. 6 is an enlarged partial section showing another embodiment of a rotary boring machine according to the present invention.
Figure 7A:
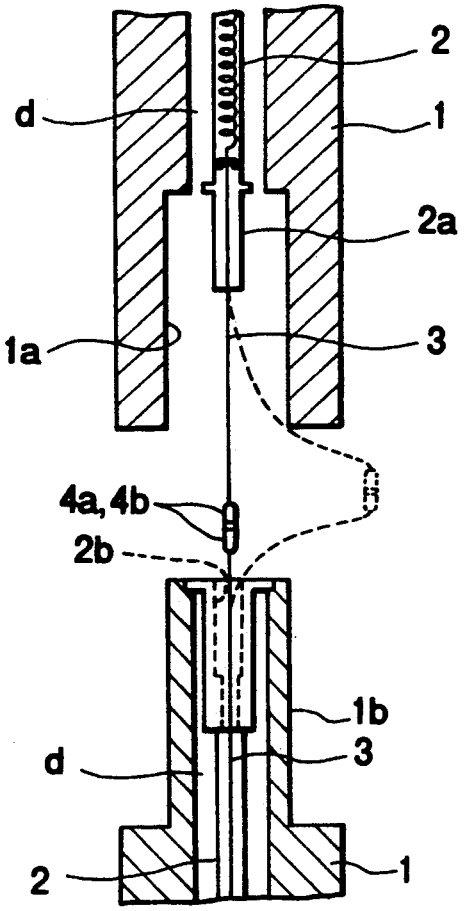
FIG.7(a) (PRIOR ART)
FIGS. 7(*a*) and 7(*b*) are illustrations of a connecting portion of the connection rods in a conventional rotary boring machine, in which FIG. 7(*a*) is an enlarged partial section showing a condition before connection, and FIG. 7(*b*) is an enlarged partial section showing a connected condition.
Figure 7B:
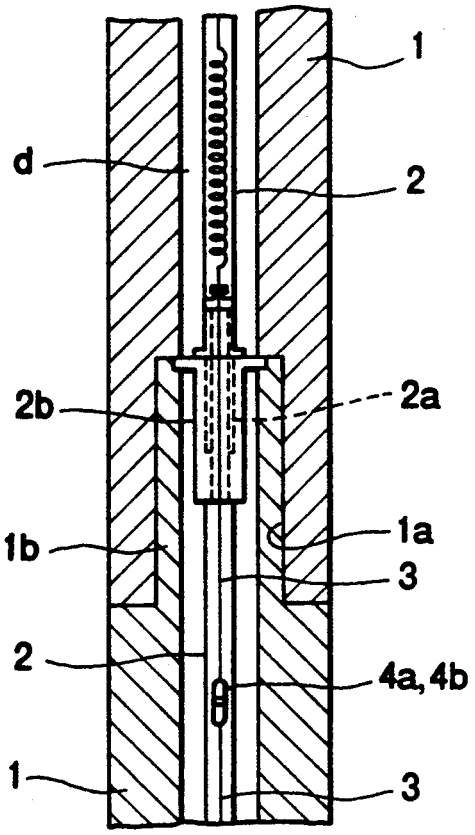
FIG.7(b) (PRIOR ART)

Next, discussion will be given of another embodiment of the rotary boring machine according to the present invention. As shown in FIG. 6, the output terminal of the dip gauge 24 is connected to the first circuit 30 provided within the interior space of the concave joint portion 28 which is formed at the upper end of the drilling tip end 14*a*, via the signal transmission line 26, such as a coaxial cable or so forth, which extends through the interior space of the drilling tip end 14*a*. The first circuit 30 is fixed on a stationary block 38 by means of fastening bolts 64. The stationary block 38 is fixed within the concave joint portion 28 via a stop ring 66. The stationary block 38 has a cylindrical downward extension 60 with a threaded outer periphery. The extension 60 threadingly engages with a pressurized fluid feeding pipe 62 which feeds pressurized air to the drilling tip end 14*a* in the shown embodiment. A ring-shaped packing 68 is arranged to surround the first circuit 30.

At the lower end of the connection rod 14*b* to be connected to the drilling tip end 14*a*, the convex joint portion 32 to engage with the concave joint portion 28 is formed. A stationary block 38 is fixed in a central hollow space of the connection rod 14*b* in the vicinity of the lower end thereof, via a stop ring 66. The second circuit 34 is secured on the stationary block 38 by means of fastening bolts 64. The stationary block 38 has substantially the same construction as that provided in the drilling tip end 14*a* and thus has an extension 60 extending upwardly and having a threaded outer periphery. The extension 60 threadingly engages with a pressurized fluid feeding pipe 62.

At a condition where the concave joint portion 28 formed at the upper end of the drilling tip end 14*a* and the convex joint portion 32 formed at the lower end of the connection rod 14*b* are integrally connected, the coil $L_1$ of the first circuit 30 and the coil $L_2$ of the second circuit 34 are opposed in the axial direction, in spaced apart relationship to form a type of transformer. Therefore, similarly to the foregoing first embodiment, when the output signal of the dip gauge 24 is applied to the coil $L_1$ of the first circuit 30, an induction current having a waveform corresponding to the waveform of the output signal of the dip gauge 24 is generated through electromagnetic induction. Namely, depending upon the output signal current of the dip gauge 24 flowing through the coil $L_1$ of the first circuit 30, the coil $L_2$ generated a varying flux corresponding to variation of the current of the output signal. When this varying flux passes across to the second circuit 34 provided in opposition to the first circuit 30, an induction current corresponding to the varying flux flows in the coil $L_2$ of the second circuit 34. Namely, the output signal of the dip gauge 24 is transmitted through the connecting portion between the concave joint portion 28 and the convex joint portion 32 in non-contacting position without employing a scanning means such as a connector. On the other hand, at the portion where the first and second circuits 30 and 34 are arranged, an annular projection 70 extending from the lower end surface of the convex joint portion 32 is press fitted onto the packing 68 to establish an air tight seal. This prevents the pressurized air fed through the pressurized fluid feeding pipe 62 from leaking at the joining portion between the concave joint portion 28 and the convex joint portion 32.

The second circuit 34 is connected to the lower end of the signal transmission line 26 provided through the hollow interior of the connection rod 14*b*. The upper end of this signal transmission line 26 is connected to a first circuit 30 provided within concave joint portion 28 of similar configuration. Namely, the output signal of the dip guage 24 is transmitted to the base machine 10 through coupling between the first and second circuits 30 and 34 from the drilling tip end 14*a* through the connection rod 14*b* and the intermediate connection rods.

As shown in FIG. 6, coupling distances between the coil $L_1$ of the first circuit 30 and the coil $L_2$ of the second circuit 34 was varied, and an insertion loss of the coupling between the first and second circuits 30 and 34 was measured. At a coupling distance $s=0$ mm, the insertion loss was 0.1 dB, at a coupling distance $s=10$ mm, the insertion loss was 5 dB, and at a coupling distance $s=20$ mm, the insertion loss was 10 dB. It should be noted that, in such experiment, the diameter of the wires of the coils $L_1$ and $L_2$ 0.6 mm, the number of turns was three, internal diameter was 55 mm, the static capacity of the tuning capacitors $C_1$ and $C_2$ was 460 pF, and the tuning frequency was 6.7 MHz.

The number of coupling of the first and second circuits 30 and 34 to be interposed between the dip gauge 24 and the monitoring system 22 can be determined so that the total loss of the loss in the signal transmission line 26 and the loss at the couplings can be maintained below the dynamic range of the receiver. Assuming that satisfactory transmission quality can be obtained by maintaining a transmitting level of +10 dBm and a receiving level of −93 dBm, the dynamic range becomes 103 dB. When the insertion loss at each of the couplings is assumed to be approximately 3 dB, a maximum of thirty-four coupling stages can be inserted.

As set forth above, in the foregoing first and second embodiments, the output of the dip gauge 24 is transmitted through electromagnetic induction between the first and second circuits 30 and 34 at every joining portion of the intermediate connection rods to reach the end connection to the output shaft 16*a* of the base machine 10. It should be appreciated that, by providing a similar coupling of first and second circuits 30 and 34 between the output shaft 16*a* as a rotating system and the base machine 10 as a stationary system, it becomes unnecessary to provide a contact type signal transmission device such as a slip ring.

As set forth above in detail, with the rotary boring machine according to the present invention, the output signal of the dip gauge is converted into an induction current corresponding to variation of the output signal by electromagnetic induction between the first and second circuits provided at the connecting portions between the drilling tip end and the connection rod, between the connection rods, and between the connection rod and the base machine, and thus is transmitted to the base machine without requiring physical connection of the signal transmission lines. Therefore, it becomes unnecessary to physically connect or disconnect the signal transmission lines at every operation of inserting and removing a connection rod. Accordingly, the operation of connecting the connection rods can be simplified and thus can be done with satisfactory safety. In addition, the construction of the boring drill can be simplified. Furthermore, since breakage of the signal transmission line and wearing of the connectors never will be caused, as maintenance costs are lowered.

Although the invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiments set forth above but to include all possible embodiments which can be embodied within the scope encompassed by and equivalents thereof with respect to the features set forth in the appended claims.

What is claimed is:

1. A rotary boring machine comprising:

a base machine placed on the ground;

a boring drill provided with said base machine and driven for rotation;

a dip gauge provided at the tip end of said boring drill;

a first circuit provided in an intermediate portion of said boring drill and electrically connected to said dip gauge for producing a varying flux corresponding to the output signal of said dip gauge;

a second circuit provided in said intermediate portion of said boring drill in opposition to said first circuit and inducting an induction current corresponding to the output signal of said dip gauge through an electromagnetic induction caused by said varying flux generated by said first circuit.

2. A rotary boring machine as set forth in claim 1, wherein each of said first and second circuits has at least inductance element.

3. A rotary boring machine as set forth in claim 2, wherein said inductance element is a coil.

4. A rotary boring machine as set forth in claim 1, wherein said boring drill comprises a drill tip end and a connecting rod in hollow rod shaped configuration.

5. A rotary boring machine as set forth in claim 4, wherein said drilling tip end is provided with said first circuit at the end to be connected with said connection rod.

6. A rotary boring machine as set forth in claim 4, wherein said connection rod is provided said first circuit at one end and said second circuit at the other end, with electrically connecting said first and second circuits at respective ends.

7. A rotary boring machine as set forth in claim 1, wherein said first and second circuits are arranged so that one of said first and second circuits surrounds the other in radially spaced relationship.

8. A rotary boring machine as set forth in claim 1, wherein said first and second circuits are arranged in vertically spaced relationship to each other with defining a gap therebetween.

9. A rotary boring machine as set forth in claim 4, wherein a concave connecting portion is formed at the upper end of said drilling tip end for connection with said connection rod.

10. A rotary boring machine as set forth in claim 4, wherein a convex connecting portion in conformance with a concave connecting portion formed at the upper end of said drilling tip end, is formed at the lower end of said connection rod, and a concave connecting portion in conformance with said convex connecting portion at said lower end is formed at the upper end of said connection rod.

* * * * *